US007793588B2

(12) United States Patent
Blaney et al.

(10) Patent No.: US 7,793,588 B2
(45) Date of Patent: Sep. 14, 2010

(54) SPRAY PATTERN VALVE BODY

(75) Inventors: Ken Francis Blaney, Rochester, NH (US); Michael Thomas Woroniak, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 1114 days.

(21) Appl. No.: 11/209,597

(22) Filed: Aug. 22, 2005

(65) Prior Publication Data

US 2007/0040051 A1 Feb. 22, 2007

(51) Int. Cl.
*B41F 7/24* (2006.01)

(52) U.S. Cl. ..... 101/148; 101/147

(58) Field of Classification Search ..... None
See application file for complete search history.

(56) References Cited

U.S. PATENT DOCUMENTS

| | | | | |
|---|---|---|---|---|
| 2,639,194 | A | 5/1953 | Wahlin | |
| 3,415,259 | A | 12/1968 | Noren et al. | 134/180 |
| 3,690,559 | A | 9/1972 | Rudloff | 239/163 |
| 3,924,531 | A | 12/1975 | Klingler | |
| 4,064,801 | A | 12/1977 | Switall | |
| 4,241,656 | A | 12/1980 | Smith | |
| 4,687,137 | A | 8/1987 | Boger et al. | 239/124 |
| 4,783,977 | A | 11/1988 | Gilpatrick | 68/205 R |
| 4,899,937 | A | 2/1990 | Haruch | |
| 5,074,242 | A | 12/1991 | Bricmont | 118/665 |
| 5,122,232 | A | 6/1992 | Lyman et al. | 162/198 |
| 5,237,923 | A | 8/1993 | Williams et al. | 101/467 |
| 5,323,807 | A | 6/1994 | Gauld et al. | |
| 5,365,974 | A * | 11/1994 | Maravic | 137/493 |
| 5,505,126 | A | 4/1996 | Ohno et al. | 101/147 |
| 5,799,871 | A | 9/1998 | Theurer | |
| 5,862,987 | A | 1/1999 | Reif | 239/209 |
| 5,958,178 | A | 9/1999 | Bartsch et al. | 156/543 |
| 5,964,410 | A | 10/1999 | Brown et al. | 239/159 |
| 6,106,623 | A | 8/2000 | Nishikawa | 118/673 |
| 6,338,445 | B1 * | 1/2002 | Lambert et al. | 239/533.12 |
| 6,513,430 | B1 | 2/2003 | Atwater | 101/365 |
| 6,514,342 | B2 | 2/2003 | Kozarek et al. | 118/315 |
| 6,561,440 | B1 | 5/2003 | Hofherr | |
| 6,786,425 | B2 | 9/2004 | Rawlings | 239/67 |
| 6,899,288 | B2 | 5/2005 | Filicicchia et al. | 239/424 |
| 7,117,788 | B2 | 10/2006 | Blaney et al. | |

* cited by examiner

*Primary Examiner*—Judy Nguyen
*Assistant Examiner*—Joshua D. Zimmerman
(74) *Attorney, Agent, or Firm*—Davidson, Davidson & Kappel, LLC

(57) ABSTRACT

A spray head is provided in which fluid flow is redirected by an insert before the fluid exits a spray nozzle. Specifically, the spray head includes an insert located within its valve body that changes the path of fluid moving through the valve body and spray nozzle cavity, resulting in increased mixing of fluid in the spray nozzle cavity and thus, improved lateral spray distribution when the fluid exits the spray nozzle.

20 Claims, 4 Drawing Sheets

SPRAY PATTERN VALVE BODY

FIELD OF THE INVENTION

The invention relates to the printing presses and more particularly to a spray head for delivering fluids.

CROSS-REFERENCE TO RELATED APPLICATIONS

This application is related to SPRAY BAR CONTROL FOR ACCOMMODATING MULTIPLE WEB WIDTHS, U.S. Publication No. 2007/0044670 and CENTRAL MANIFOLD SUPPLY FOR SPRAY BAR, U.S. Publication No. 2007/0045453, the entire disclosures of which are hereby incorporated by reference.

BACKGROUND

It is known in the printing industry to use spray heads to deliver fluid to a plate cylinder. Spray heads include spray nozzles which are modified to spray a certain type of spray distribution. However, each spray nozzle works in conjunction with the spray head which includes a valve body and solenoid for the delivery of the fluid. Thus, the desired spray distribution is achieved, in part, by the operation among the spray nozzle, valve body and solenoid. Further affecting spray distribution is the geometry of the valve body.

In addition, typical prior art spray heads have a lag time from the time when the solenoid valve is turned off to the time the fluid stops being ejected from the tip of the spray nozzle. This lag time increases with increased volume in the spray nozzle cavity. Moreover, during this time, the fluid pressure is lower than desired and does not generate a fully developed spray distribution pattern. This creates a situation where more fluid is sprayed from the center of the spray nozzle than from the edges, resulting in a non-uniform lateral distribution.

In an attempt to decrease lag time, prior art arrangements have minimized the volume of the fluid in the area between the valve and the tip of the spray nozzle. Prior art arrangements have tried to decrease the size of the orifice in the valve body and have tried to fill the volume of the back cavity of the spray nozzle with a nipple featured on the valve body. Unfortunately, these arrangements tend to direct the fluid straight through the center of the tip of the spray nozzle, thus preventing a fully developed spray pattern from being generated.

SUMMARY OF THE INVENTION

In accordance with an embodiment of the present invention, a spray head is provided that redirects fluid flow with an insert before the fluid exits a spray nozzle. The spray head includes an insert located within its valve body that changes the path of fluid moving through the valve body and spray nozzle cavity, resulting in increased mixing of fluid in the spray nozzle cavity and thus, improved lateral spray distribution when the fluid exits the spray nozzle.

In accordance with a further embodiment of the present invention, a spray head is provided which includes a spray nozzle, a valve body, and an insert. The spray nozzle has a nozzle output. The valve body having an input, an output, and an interior passage extending from the valve input to the valve output. The output is connected to the spray nozzle. The insert is disposed in a fluid path between the valve input and the nozzle output, and the insert redirects fluid flow between the valve input and the nozzle output.

BRIEF DESCRIPTION OF THE DRAWINGS

Further objects, features and advantages of the invention will become apparent from the following detailed description taken in conjunction with the accompanying drawings, in which:

FIG. 1(*c*) shows a typical dampening system of a printing unit of a printing press.

DETAILED DESCRIPTION

Figure 1A:
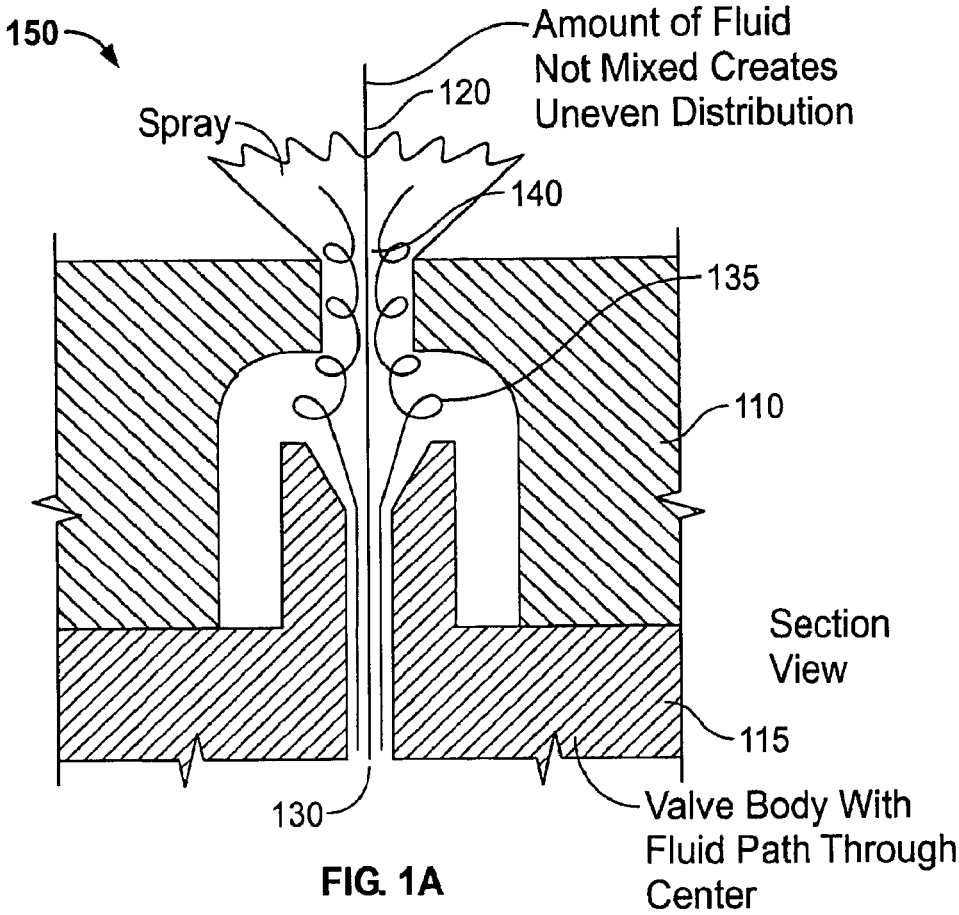
FIG. 1A (Prior Art)
FIGS. 1(*a*) and 1(*b*) illustrate a prior art spray head and a corresponding lateral spray distribution chart exaggerated in scale for illustration purposes.
Figure 1B:
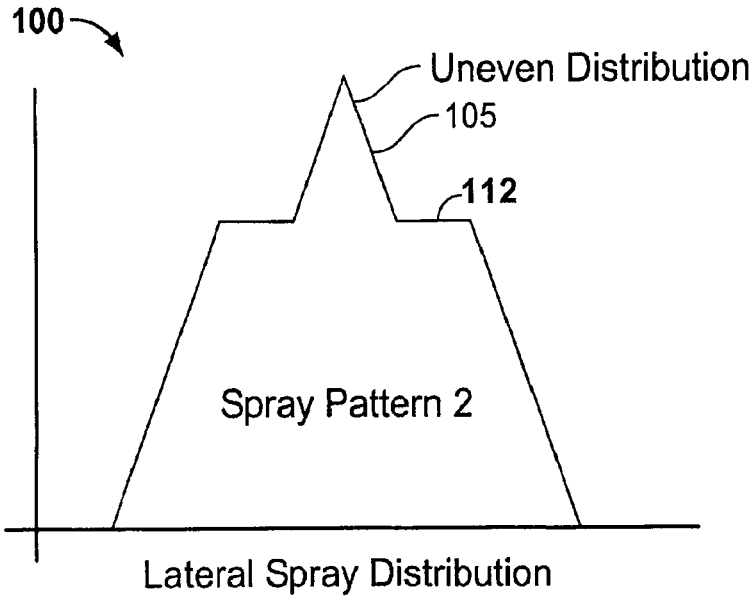
FIG. 1B (Prior Art)
Figure 1C:
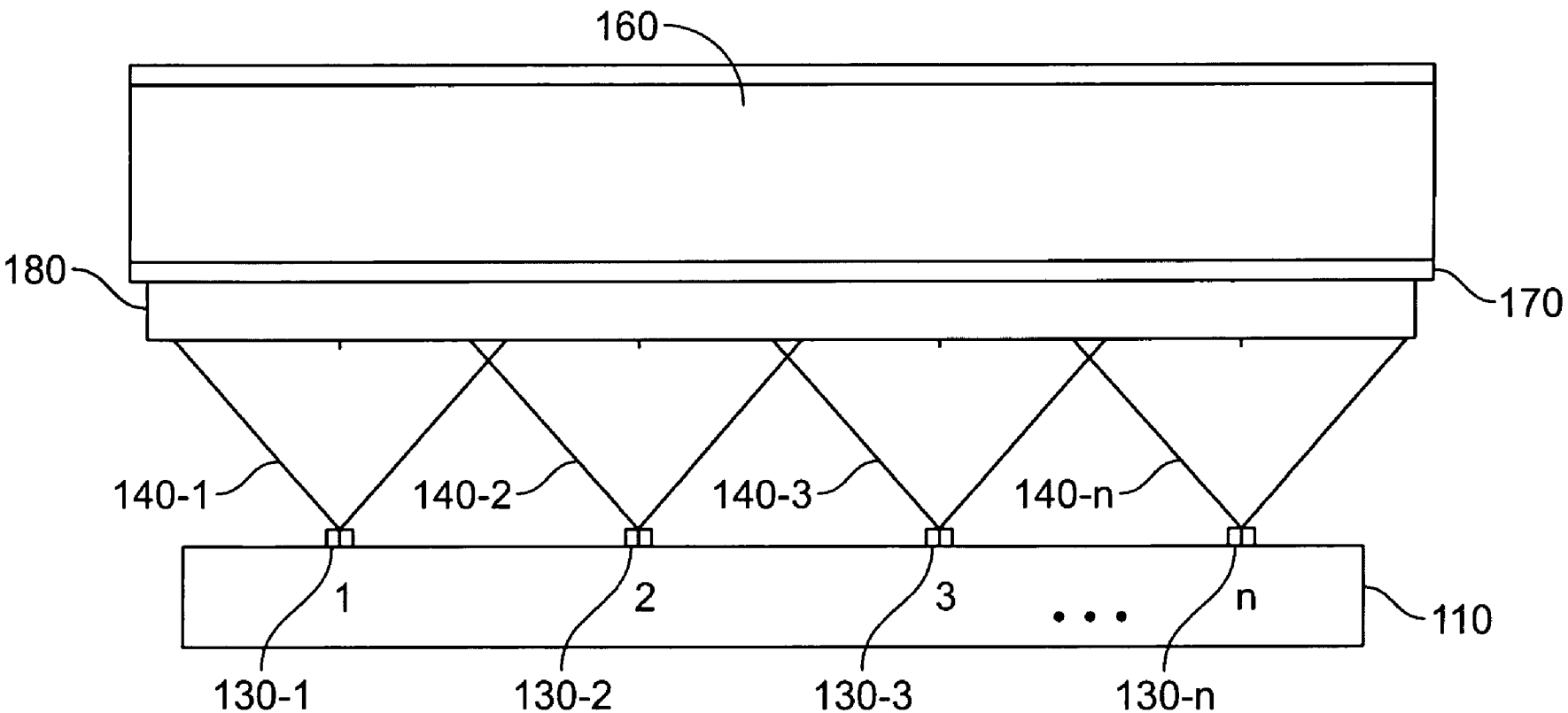

Referring to FIG. 1(*a*), prior art spray head 150 is shown with a valve body 115 which is connected to a nozzle 110 having a cavity 135 and a nozzle orifice 140. When fluid 130 travels through valve body 115 some of fluid 130 mixes in cavity 135 and some of fluid 130 passes straight through nozzle orifice 140 without mixing, as shown in FIG. 1(*a*). The result is a spike 120 in spray 125 of fluid 130. These prior art spray heads 150 tend to direct some of fluid 115 straight through the center of the tip of nozzle 110, resulting in a spike in fluid distribution, as indicated in FIG. 1(*b*). FIG. 1(*b*) shows a lateral spray distribution of prior art spray head 150. Line 112 represents a generally uniform lateral spray distribution while line 105 represents a spike in lateral spray distribution. As mentioned above, the spike (denoted line 105) is the result of fluid 130 being passed through nozzle orifice 130 with little or no mixing in cavity 135, resulting in a non-uniform lateral spray distribution.

FIG. 1(*c*) shows a typical dampening system of a printing unit including spray heads 130-1 to 130-n arranged to spray a fluid, such as a fountain solution, onto a dampener roll which transmits the fluid to one or more further dampener rolls (collectively dampener roll arrangement 180) which in turn transmit the fluid to a printing plate 170 of a plate cylinder 160 of a printing unit.

In accordance with an embodiment of the present invention, a spray head is provided for improving lateral spray distribution. In accordance with the embodiments of the present invention, the spray head creates a fully developed spray pattern from the nozzle tip and minimizes fluid exit time from the spray nozzle after the solenoid valve has been closed.

Figure 2A:
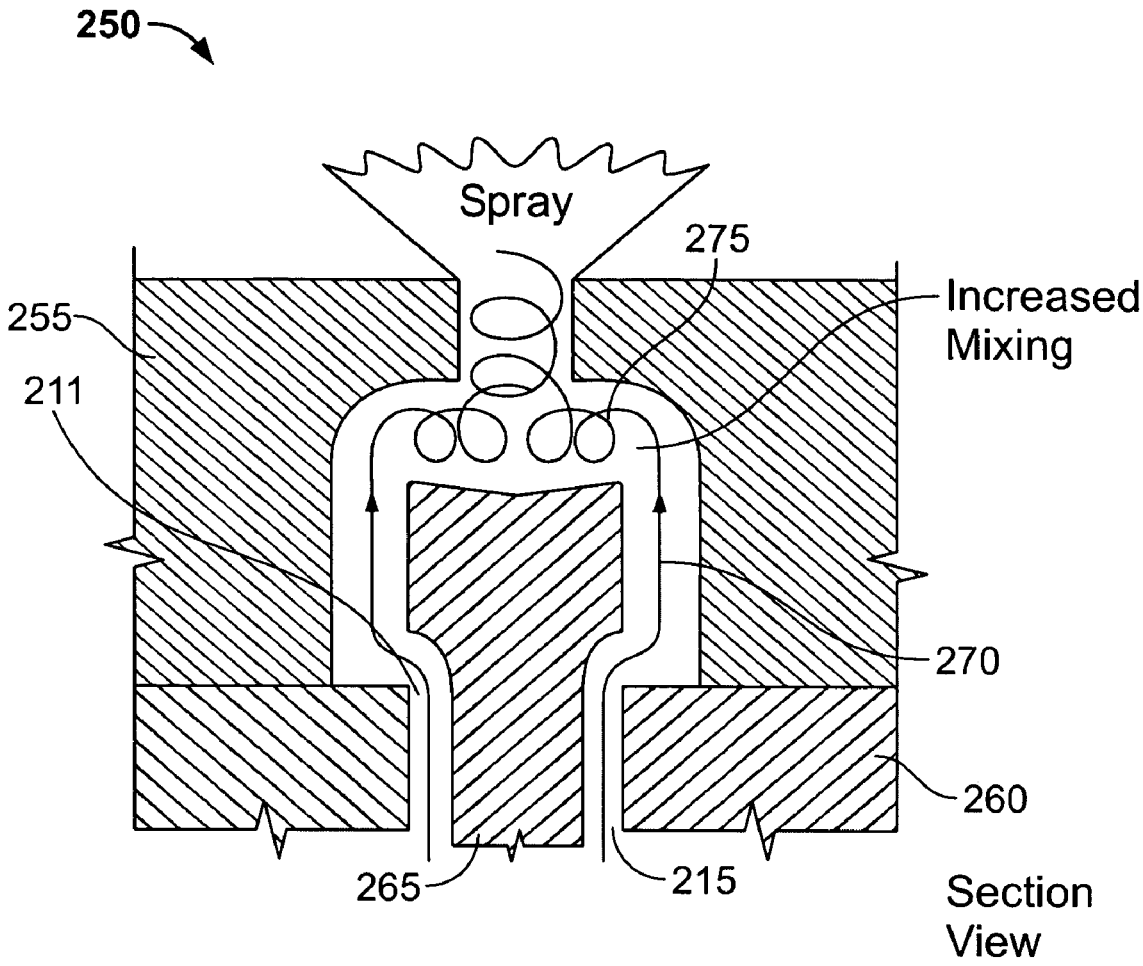
FIGS. 2(*a*) and 2(*b*) illustrate a spray head and insert with a corresponding lateral spray distribution chart in accordance with an embodiment of the present invention.
Figure 2B:
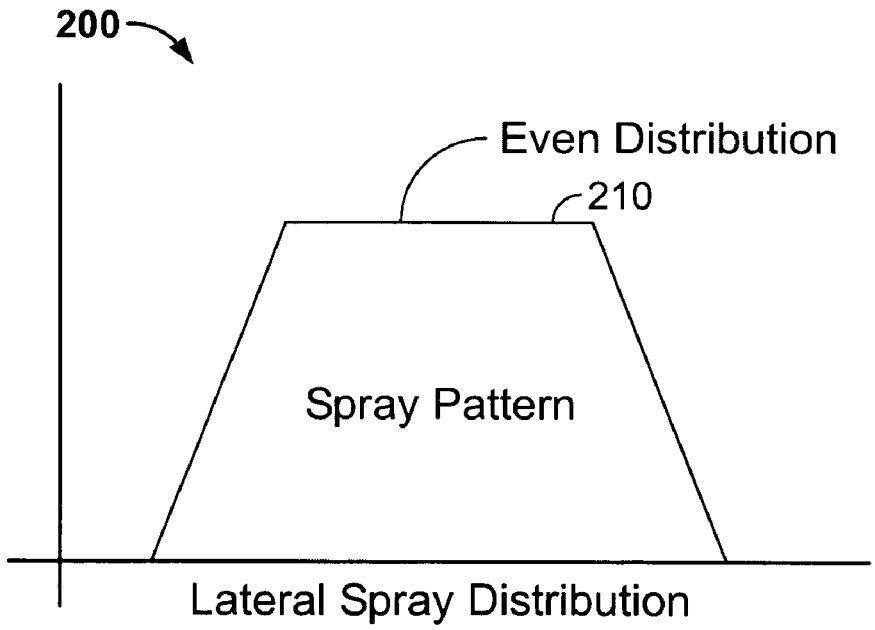

FIG. 2(*a*) illustrates a spray head 250 embodying the principles of the present invention for improving lateral spray distribution. As shown in FIG. 2(*a*), spray head 250 includes a spray nozzle 255 connected to a valve body 260. Valve body 260 has a valve input (not shown) connected to a valve output 211 through an interior passage 215. Located within spray nozzle 255 and valve body 260 is an insert 265. Insert 265 changes the path of fluid 270 moving through valve body 260 and spray nozzle 255, resulting in increased mixing of fluid 270 in nozzle cavity 275.

FIG. 2(*b*), illustrates a lateral spray distribution of spray head 250. Line 210 represents the spray distribution of fluid through spray head 250 onto, for example, a printing plate 170 of plate cylinder 160 via dampener roll assembly 180, as illustrated in FIG. 1(*c*). As shown in FIG. 2(*b*), the top of line 210 is a horizontal line representing uniform lateral spray distribution. The uniform lateral spray distribution indicated by line 210 is the result of increased mixing of fluid 270 in nozzle cavity 275 caused by insert 265.

Figure 3A:
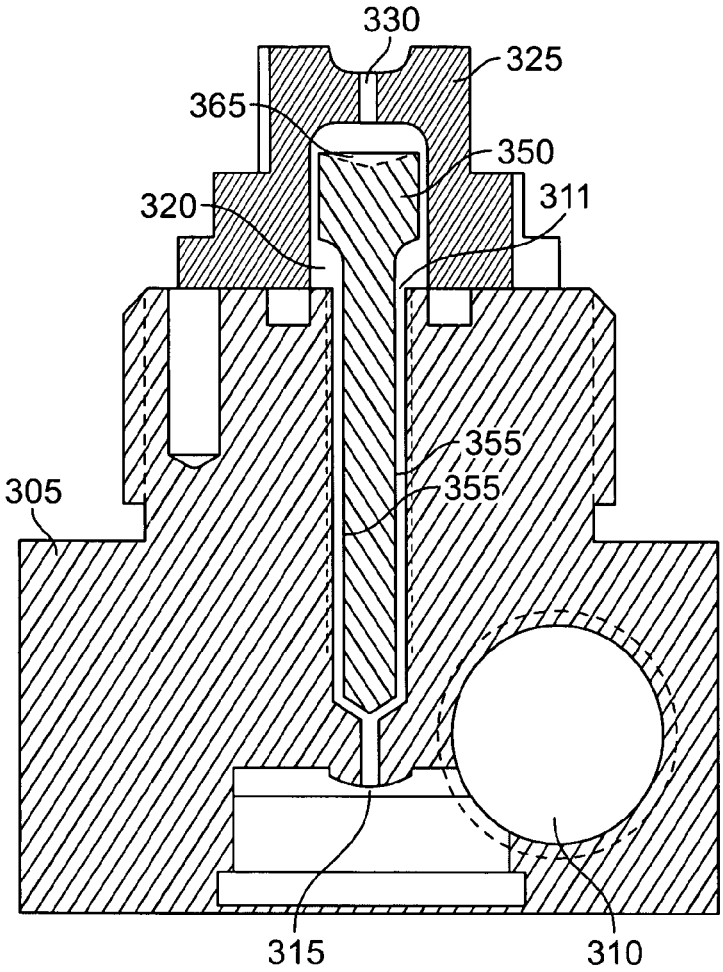
FIG. 3(*a-c*) illustrate a spray head and insert in accordance with a further embodiment of the present invention.
Figure 3B:
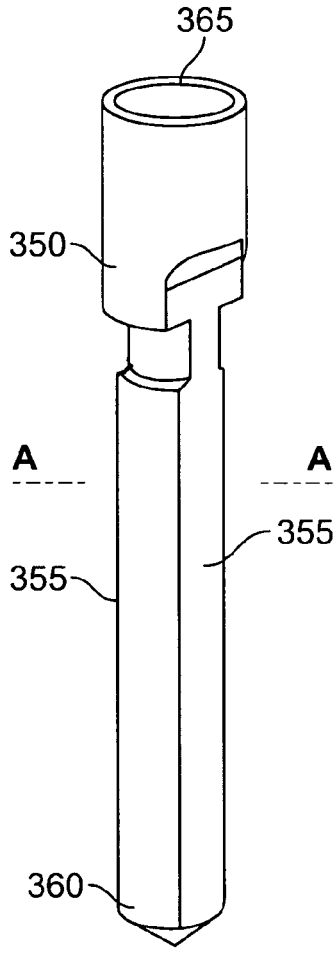
Figure 3C:
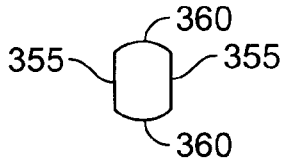

FIG. 3(*a-c*) illustrate a spray head 300 and an insert 350 in accordance with a further embodiment of the present invention. Spray head 300 includes a valve body 305 which has an input, a feed port 310, connected to a valve body orifice 315 which terminates at a valve output 311. Valve body 305 is connected to a spray nozzle 325 resulting in valve body orifice 315 being connected to spray nozzle 325. Spray nozzle 325 includes, as its input, a back cavity 320 and, as its output, a nozzle orifice 330. Also illustrated in FIG. 3 (*a-c*) is an insert 350 in accordance with an embodiment of the invention. Insert 350 is elongated and includes threaded area 360, cup area 365 and a pair of opposing flats 355. Insert 350 is threaded on the outside diameter (denoted threaded area 360) and is designed to thread with a corresponding threaded portion of valve body orifice 315 to secure insert 350 to valve body 305. By virtue of the opposing flats 355, a passage is formed between the flats 355 and the threaded wall of valve body orifice 315. The portion of the insert 350 disposed in the back cavity 320 has a width that is greater than the width of the portion of insert 350 that is in the valve body orifice 330. FIG. 3*c* shows a cross section through insert 350 of FIG. 3*b* along line A-A.

Referring to spray head 300, fluid enters valve body 305 through feed port 310 and through valve body orifice 315. As shown in FIG. 3*a*, valve body orifice 315 changes in diameter over distance. Preferably, the diameter of orifice 315 is smaller in a portion of the orifice upstream of the insert 350 than in the portion of the orifice which holds the insert 350. Referring to spray head 300 and insert 350, the fluid travels between valve body orifice 315 and flats 355 of insert 350 until the fluid exits valve body 305. The fluid enters back cavity 320 of spray nozzle 325 and exits spray nozzle 325 by flowing around the tip of insert 350 and out nozzle orifice 330 onto, for example, a dampener roll. It should be realized that the shape of recessed cup area 365 at the top of insert 350 can be varied to optimize fluid flow while the valve is open and minimize the amount of residual fluid droplets (e.g. residual fountain solution droplets) from escaping after the valve is closed.

The foregoing merely illustrates the principles of the invention. It will thus be appreciated that those skilled in the art will be able to devise numerous other arrangements which embody the principles of the invention and are thus within its spirit and scope.

For example, based on the above disclosure, it is apparent that the principles of the invention can readily accommodate various cup areas and shapes to achieve the benefits of the invention.

In addition, based on the disclosure, it is apparent that insert 350 can readily accommodate more or less flats and shapes.

What is claimed is:

1. A printing unit comprising:

a dampener roll arrangement including a dampener roll;

a plate cylinder; and a plurality of spray heads arranged to spray fluid onto the dampener roll of the dampener roll arrangement, the dampener roll arrangement transmitting the fluid onto a printing plate mounted on the plate cylinder, each spray head including:

a spray nozzle having a nozzle output, a valve body having an input, an output, and an interior passage extending from the valve input to the valve output, the output connected to the spray nozzle, and an insert disposed in a fluid path between the valve input and the nozzle output defining at least a portion of the interior passage and arranged such fluid flow between the valve input and the nozzle output is redirected by an input end of the insert around a length of the insert.

2. The printing unit as recited in claim 1 wherein the insert has an elongated shape.

3. The printing unit as recited in claim 1 wherein the spray nozzle has an input chamber coupled to the nozzle output, and wherein the insert extends from within the interior passage into the input chamber.

4. The printing unit as recited in claim 3 wherein the input chamber has a diameter which is greater than a diameter of the interior passage.

5. The printing unit as recited in claim 4 wherein a portion of the insert in the input chamber has a width greater than a width of a portion of the insert in the interior passage.

6. The printing unit as recited in claim 3 wherein the insert includes a top having a cup-shaped area at an output end of the insert.

7. The printing unit as recited in claim 1 wherein the insert includes one or more flats for redirecting fluid flow.

8. The printing unit as recited in claim 1 wherein the insert is connected to the interior passage by threads.

9. A printing unit comprising:

a dampener roll arrangement including a dampener roll;

a plate cylinder; and a plurality of spray heads arranged to spray fluid onto the dampener roll of the dampener roll arrangement, the dampener roll arrangement transmitting the fluid onto a printing plate mounted on the plate cylinder, each spray head including:

a spray nozzle;

a valve body having an orifice connected to the spray nozzle; and an insert within the orifice for redirecting fluid flow through the orifice before the fluid exits the spray nozzle by forcing fluid around an entire length of the insert.

10. The printing unit as recited in claim 9 wherein the insert has an elongated shape.

11. The printing unit as recited in claim 9 wherein the spray nozzle has an input chamber coupled to the nozzle output, and wherein the insert extends from within the interior passage into the input chamber.

12. The printing unit as recited in claim 11 wherein the input chamber has a diameter which is greater than a diameter of the interior passage.

13. The printing unit as recited in claim 12 wherein a portion of the insert in the input chamber has a width greater than a width of a portion of the insert in the interior passage.

14. The printing unit as recited in claim 11 wherein the insert includes a top having a cup-shaped area.

15. The printing unit as recited in claim 9 wherein the insert includes one or more flats for redirecting fluid flow.

16. The printing unit as recited in claim 9 wherein the insert is connected to the interior passage by threads.

17. A printing unit comprising:

a dampener roll arrangement including a dampener roll;

a plate cylinder; and a plurality of spray heads arranged to spray fluid onto the dampener roll of the dampener roll arrangement, the dampener roll arrangement transmitting the fluid onto a printing plate mounted on the plate cylinder, each spray head including:

a spray nozzle having a nozzle output, a valve body coupled to the spray nozzle having an input, an output, and defining an interior passage extending from the valve input to the valve output, the output connected to the spray nozzle, and an insert including a portion of lesser width near the input of the valve body and a portion of greater width near the nozzle output, the portion of lesser width being coupled to the interior passage.

18. The printing unit recited in claim 17 wherein the portion of lesser width is coupled to the interior passage via a threaded area of the portion of lesser width interacting with a threaded area of the interior passage.

19. The printing unit recited in claim 18 wherein the threaded area of the portion of lesser width includes at least a first threaded side and a second threaded side and the portion of lesser width includes at least a first flat side and a second flat side separating the first threaded side and the second threaded side.

20. The printing unit recited in claim 19 wherein the first flat side and the second flat side form fluid flow paths coupling the valve body input to the valve body output.

* * * * *